US006290523B1

(12) United States Patent
Barnhart et al.

(10) Patent No.: US 6,290,523 B1
(45) Date of Patent: Sep. 18, 2001

(54) SELF DOCKING INSTRUMENT PANEL CONNECTOR SYSTEM

(75) Inventors: Robert Barnhart, Eastpointe; Renee J. Bohn, Beverly Hills; Paul G. Grubba, Troy; Scott S. Owens, Farmington Hills; Christopher G. Saari, Novi; Thomas O. Sandusky, Chesterfield; Timothy A. Waligora, Sterling Heights, all of MI (US); Anthony J. Pill, Naperville, IL (US); Russell L. Mackowiak, Wheaton, IL (US); C. Robert Moon, Joliet, IL (US); Kenneth T. Stead, Aurora, IL (US); Andrew Kuzdak, III, Rochester Hills, MI (US)

(73) Assignees: DaimlerChrysler Corporation, Auburn Hills, MI (US); Molex, Inc., Lisle, IL (US)

( * ) Notice: Subject to any disclaimer, the term of this patent is extended or adjusted under 35 U.S.C. 154(b) by 0 days.

(21) Appl. No.: 09/485,646

(22) PCT Filed: Jul. 29, 1998

(86) PCT No.: PCT/US98/15831

§ 371 Date: Jul. 18, 2000

§ 102(e) Date: Jul. 18, 2000

(87) PCT Pub. No.: WO99/09620

PCT Pub. Date: Feb. 25, 1999

Related U.S. Application Data

(60) Provisional application No. 60/055,670, filed on Aug. 14, 1997.

(51) Int. Cl.[7] ..... H01R 13/64

(52) U.S. Cl. ..... 439/248

(58) Field of Search ..... 439/248, 247, 439/557, 558, 680, 191, 251, 817, 34, 364, 752, 595; 210/321.6

(56) References Cited

U.S. PATENT DOCUMENTS

| | | | | |
|---|---|---|---|---|
| 4,917,619 | * | 4/1990 | Nishiwaki | 439/191 |
| 5,071,374 | * | 12/1991 | Plocek et al. | 439/248 |
| 5,263,871 | * | 11/1993 | San | 439/157 |
| 5,514,000 | * | 5/1996 | Krane et al. | 439/248 |
| 5,642,999 | * | 7/1997 | Kidd et al. | 439/34 |
| 5,836,787 | * | 11/1998 | KoDama | 439/199 |
| 5,857,863 | * | 1/1999 | Kodama | 439/567 |
| 6,068,770 | * | 5/2000 | Niermeyer | 210/321.6 |

* cited by examiner

*Primary Examiner*—Brian Sircus
*Assistant Examiner*—J. F. Duverne
(74) *Attorney, Agent, or Firm*—Roland A. Fuller, III

(57) ABSTRACT

A self docking instrument panel connector system is provided with a first connector member (18) attached to an instrument panel assembly (12). A second connector member (20) is attached to a body of a vehicle (16) and is designed to mate with the first connector member (18). One of the connector members (20) is adjustably supported to be movable in first and second lateral directions and in a longitudinal direction in order to accommodate for build tolerances and component insertion variances.

12 Claims, 6 Drawing Sheets

SELF DOCKING INSTRUMENT PANEL CONNECTOR SYSTEM

The benifit of provisional application No. 60/055,670, filed Aug. 14, 1997 is claimed.

BACKGROUND OF THE INVENTION

1. Field of the Invention

The present invention relates to electrical connectors, and more particularly to a self docking instrument panel connector system.

2. Background and Summary of the Invention

Currently, vehicles are designed such that the body and engine compartment wiring connections must be manually mated to the instrument panel wiring after the instrument panel is installed in the vehicle. The process of manually mating the instrument panel wiring with the body and engine compartment wiring requires additional manpower to perform operations which are not ergonomically friendly.

The present invention is directed to a self docking instrument panel connector system whereby the electrical connection from a vehicle's instrument panel wiring to its body and engine compartment wiring is improved by eliminating the need to manually mate the wiring connectors together. The improved instrument panel connector system has a stationary connector and an adjustable connector. The connector system compensates for build tolerances and component insertion variances automatically. The adjustable connector is capable of moving in three axes as well as being capable of limited rotational movement. The ability of the adjustable connector to move in all three axes as well as having limited rotational movement facilitates an improved mating arrangement between the adjustable connector and the stationary connector as the instrument panel is installed in the vehicle.

The present invention provides an electrical connector having a first connector member supporting at least one electrical terminal. A second connector member supports at least one electrical terminal for mating with the at least one electrical terminal supported by the first connector member when one of the first and second connector members is moved longitudinally toward the other. A bracket is provided for supporting the second connector member. The second connector member is supported so as to be laterally movable in two directions relative to said bracket. The bracket is mounted to a mounting surface and capable of being automatically adjustably seated longitudinally relative thereto when the first and second connector members engage each other.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
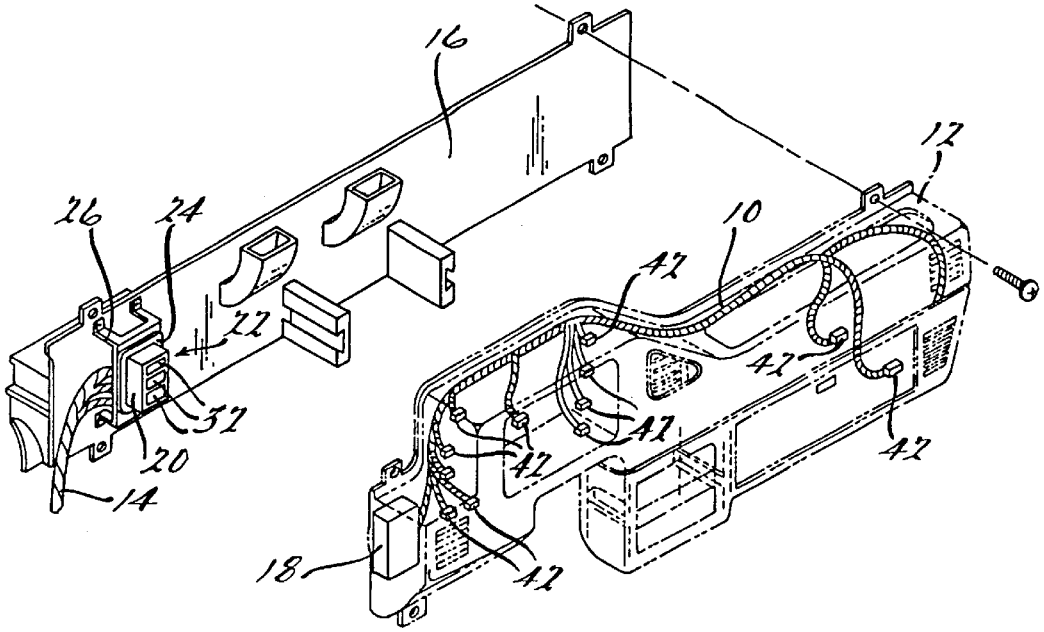
FIG. 1 is an exploded perspective view of a wire harness coupler embodying the present invention.
Figure 2:
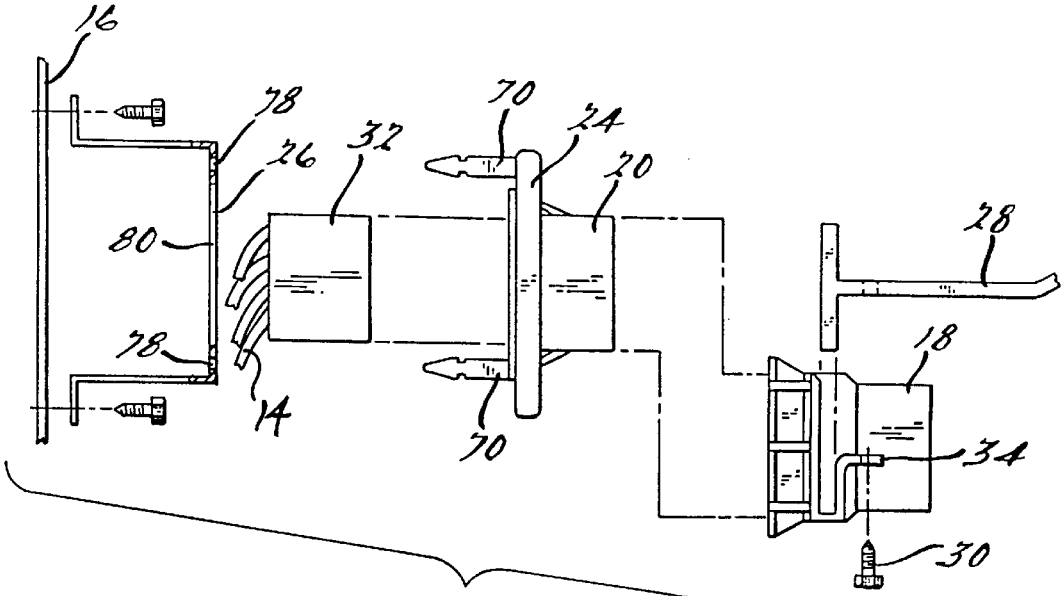
FIG. 2 is an exploded side view of the instrument panel connector system of the present invention.
Figure 3:
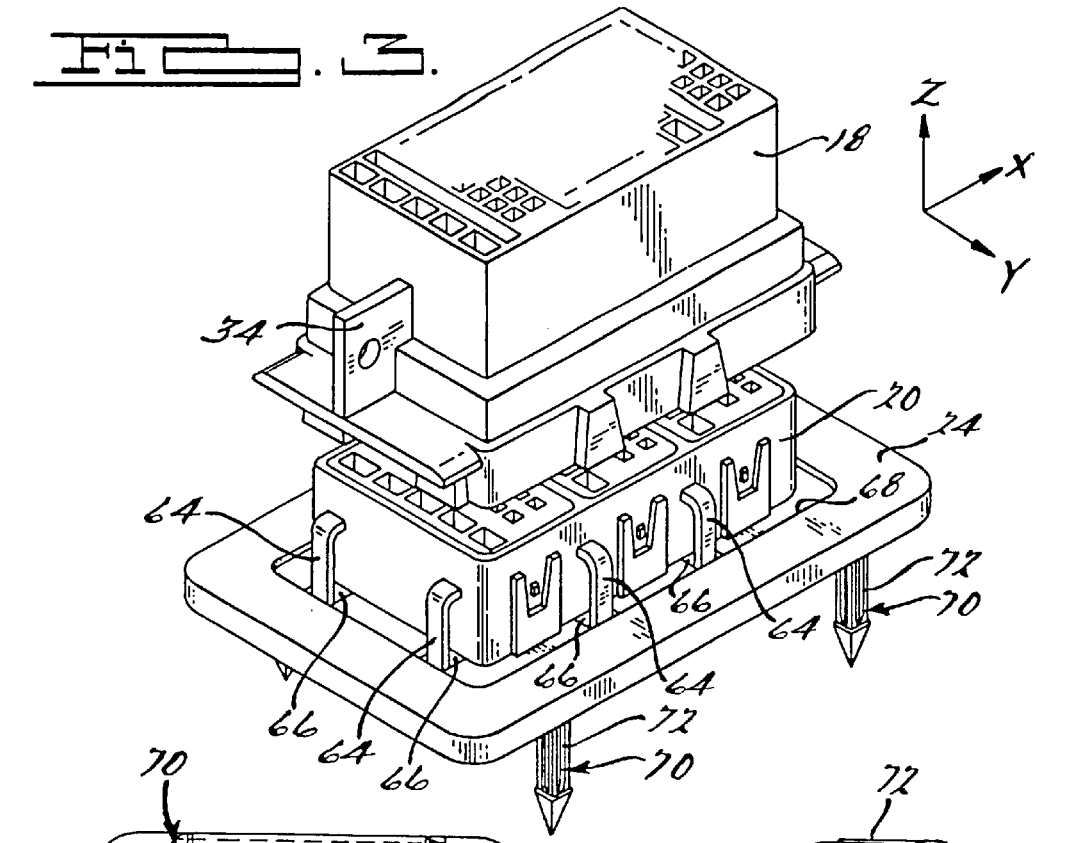
FIG. 3 is a perspective view of the electrical connector according to the principles of the present invention.
Figure 4:
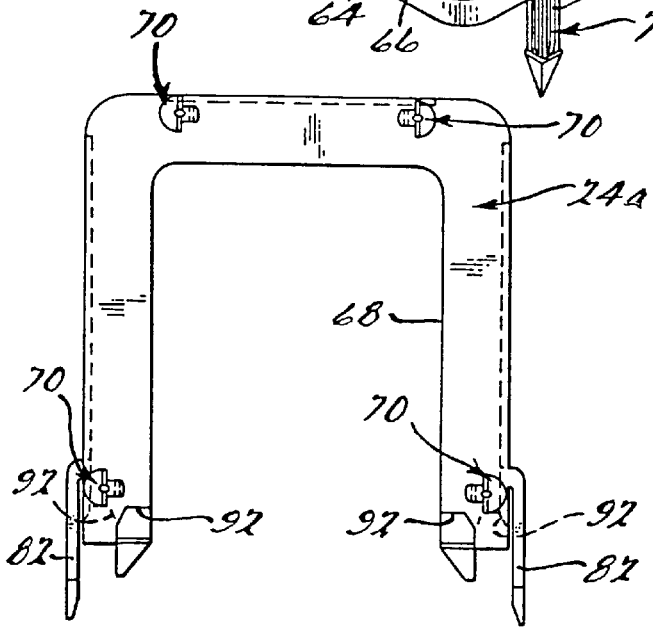
FIG. 4 is a front view of an outer bracket for use with the present invention.
Figure 6:
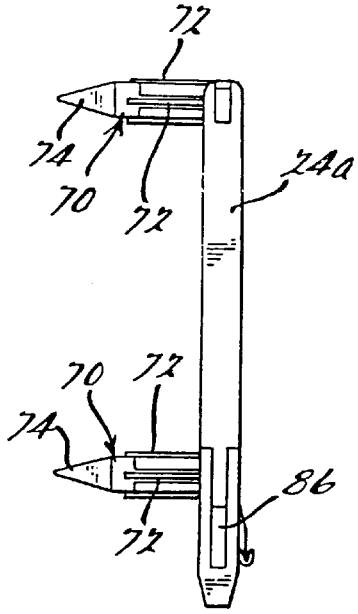
FIG. 6 is a side view of the outer bracket shown in FIG. 4.
Figure 5:
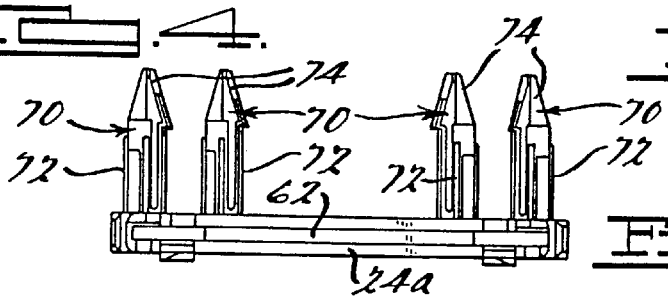
FIG. 5 is an end view of the outer bracket shown in FIG. 4.

With reference to FIGS. 1–18, the present invention will be described in detail. The self docking instrument panel connector system of the present invention allows the connection of the wire harness 10 of the instrument panel 12 to be connected to the body and engine compartment harnesses 14 automatically when the instrument panel 12 is connected to the body of the vehicle 16. The vehicle body 16 may include the dash panel, side cowls, a cowl top, floor pan reinforcement or many other body parts. The self docking instrument panel connector system includes a stationary or fixed connector 18 which is mounted to the instrument panel assembly 12. The fixed connector 18 engages an inner bracket 20 of a connector holding assembly 22. Connector holding assembly 22 includes an outer bracket 24 which supports inner bracket 20. Outer bracket 24 is mounted to optional mounting bracket 26 or body 16. The stationary or fixed connector 18 is provided with a pair of mounting portions 34 which can be connected to the instrument panel 12 by a bracket such as instrument panel reinforcement 28. The stationary or fixed connector 18 can be fastened to reinforcement 28 by screws 30, bolts, or other means.

Figure 13:
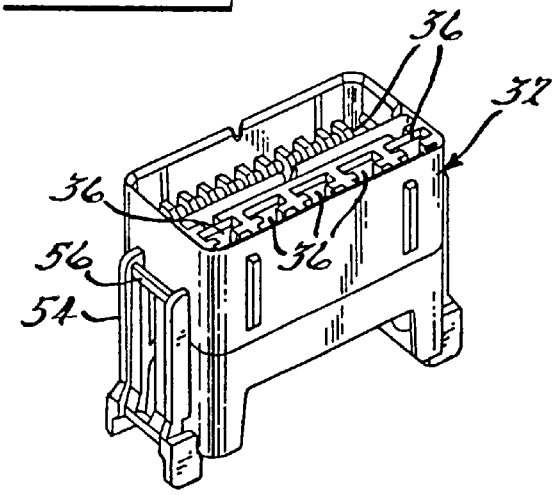
FIG. 13 is a perspective view of a 25-way connector assembly.

Inner bracket 20 supports a plurality of inner connector assemblies 32 which include a plurality of female terminals 36, as shown in FIG. 13, which are connected to respective wires on the wire harnesses 14. A plurality of male terminals 38 are supported by the outer connector 18. The male terminals 38 are connected to individual wires 40 of wire harness 10. The wire harness 10 is connected to a plurality of connectors 42 which are disposed within the instrument panel 12 for delivering electrical signals to and from a plurality of instrument panel actuators and displays.

Figure 15:
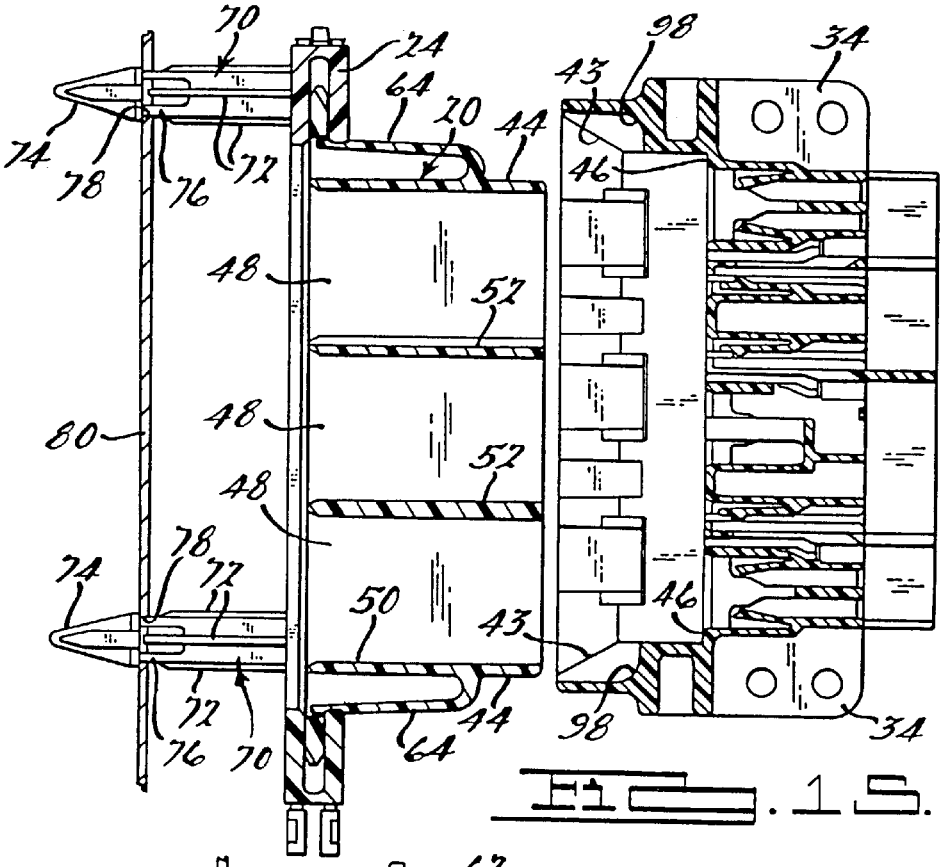
FIG. 15 is a cross-sectional view illustrating the engagement of the stationary or fixed connector with the inner bracket of the adjustable connector assembly.
Figure 17:
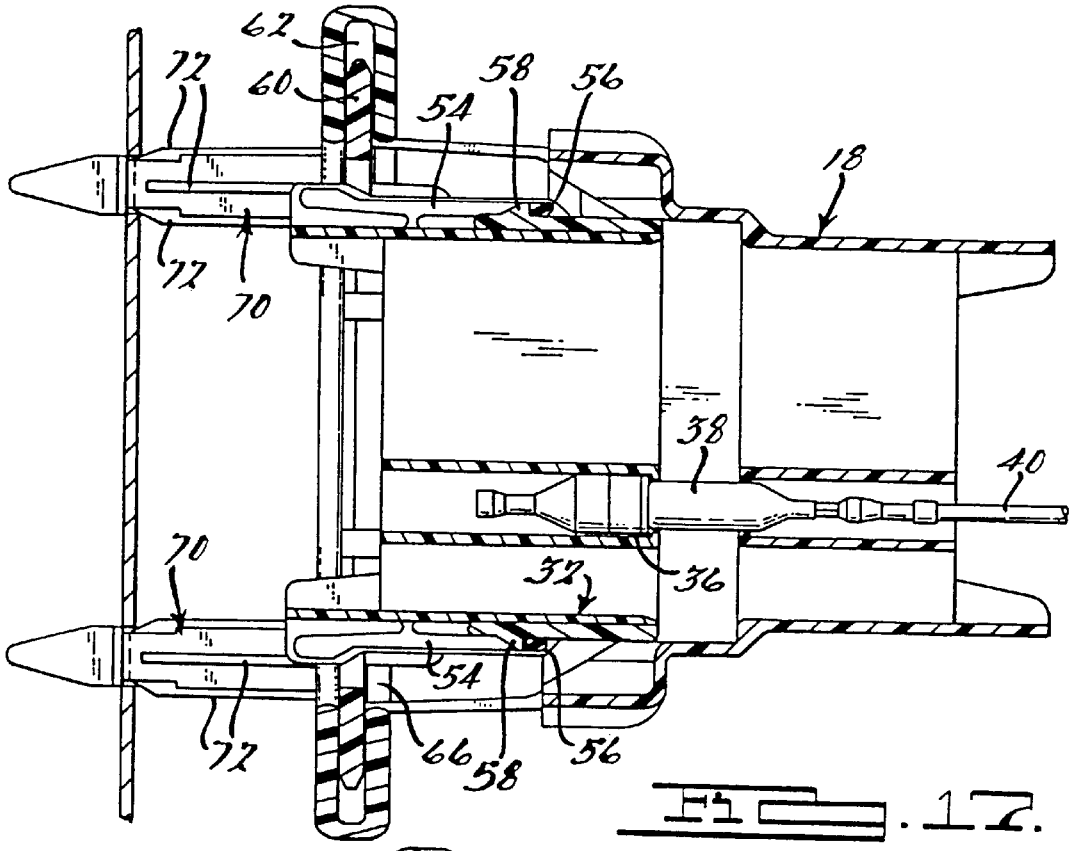
FIG. 17 is a cross-sectional view illustrating the connection of a male and female connector supported by the stationary or fixed connector and one of the inner connectors of the adjustable connector assembly.
Figure 18:
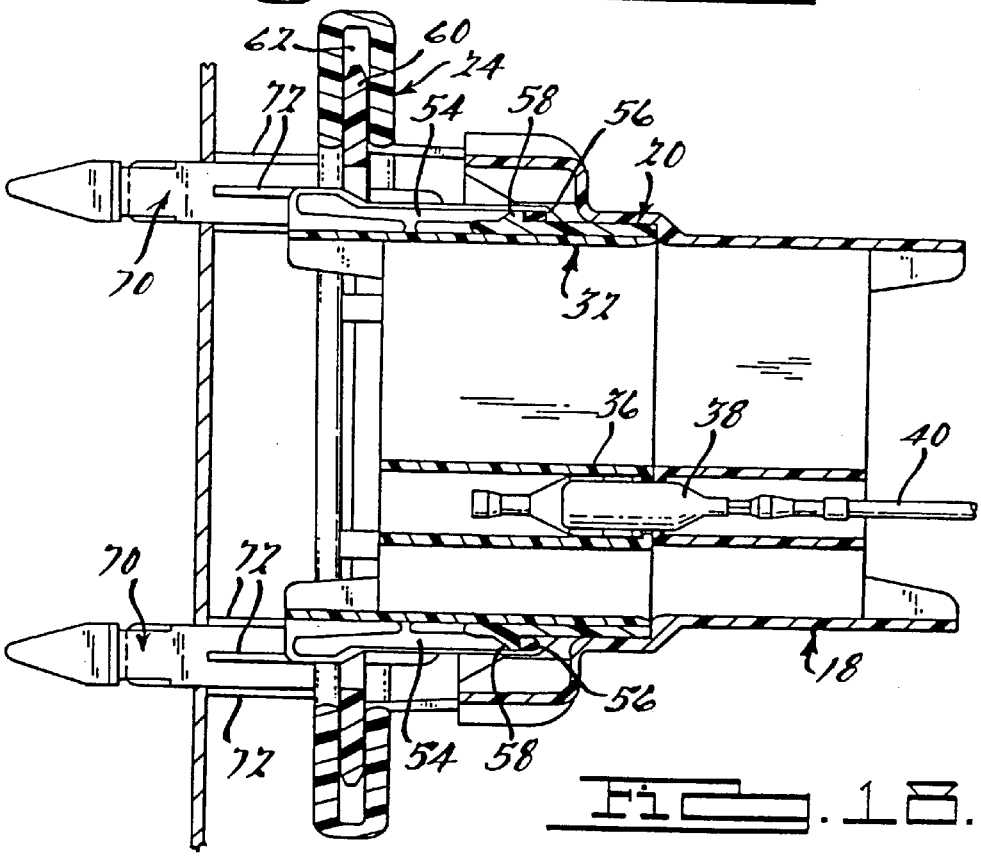
FIG. 18 is a cross-sectional view illustrating the stationary or fixed connector engaged with the inner bracket or the adjustable connector assembly and with the prongs of the outer bracket being recessed in the holes of the mounting surface.

Outer connector 18 is provided with a funnel surface 43, best seen in FIG. 15, which engages an upper surface 44 of inner bracket 20 and properly centers inner bracket 20 with respect to the seating portion 46 of outer connector 18. The male terminals 38 supported by the stationary or fixed connector 18 engage with female terminals 36 of a connector assembly 32 as shown in FIGS. 17 and 18. According to a preferred embodiment, inner bracket 20 is provided with three pockets 48 for supporting three connector assemblies 32. Pockets 48 are defined by outer wall 50 and center walls 52 of the inner bracket 20.

Figure 14:
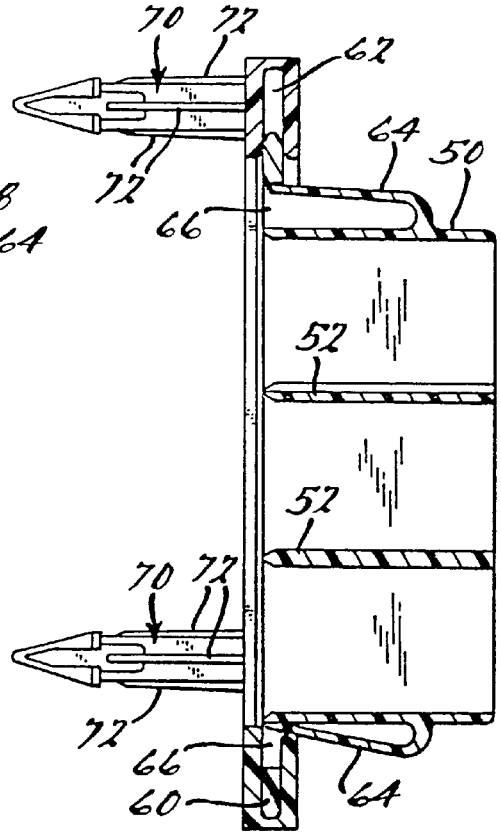
FIG. 14 is a cross-sectional view of a connector holding assembly according to the principles of the present invention.

Connector assemblies 32 are provided with a latching mechanism 54, each having a locking member 56 which engages a locking tab 58 disposed on the outer wall 50 of inner bracket 20. Inner bracket 20 includes a flanged portion 60 received in a slot 62 of outer bracket 24. Inner bracket 20 is also provided with a plurality of lateral spring members 64 which extend laterally outward from an upper portion of outer wall 50. Spring members 64 extend downward toward flange 60. Flange 60 includes a plurality of openings 66 which receive an end of lateral spring members 64. Lateral spring members 64 engage an inner surface 68 of outer bracket 24 adjacent to slot 62. Lateral spring members 64 bias inner bracket 20 to a centered position relative to outer bracket 24. However, lateral spring members 64 are flexible to enable adjustment of the positioning of inner bracket 20 relative to outer bracket 24 as illustrated in FIG. 14. Thus, the lateral position of inner bracket 20 is automatically adjustable for aligning itself with outer connector 18 in the x and y lateral directions shown in FIG. 3.

Outer bracket 24 includes a plurality of prongs 70 which are each provided with a plurality of crush ribs 72 along a radial surface thereof. Prongs 70 are provided with a pointed tip 74 having a seat portion 76. The pointed tip 74 of prongs 70 are inserted into holes 78 of a mounting surface 80. During the assembly of the instrument panel 12 to the vehicle body 16, there are many tolerances which must be accounted for during connection of the stationary or fixed connector 18 to inner bracket 20 of connector holding assembly 22. These tolerances exist in all three dimensions (x,y,z), and therefore require that the inner bracket 20 be movable in all three directions (x,y,z). Therefore, the inner bracket 20 is adjustable relative to outer bracket 24 in two lateral dimensions (x,y) due to the flange 60 being movable in slot 62 of outer bracket 24. In addition, prongs 70 are capable of being adjustably seated in holes 78 (in the z direction) of mounting surface 80, as illustrated in FIG. 18. In particular, when prongs 70 are pushed or forced into holes 78 of mounting surface 80, the crush ribs 72 are shaved away from prongs 70. Alternatively, crush ribs 72 can merely deform upon insertion through holes 78. The ability of the prongs 70 to be adjustably seated in holes 78 of mounting surface 80 allow the inner bracket 20 to move in the longitudinal (z) direction when the instrument panel 12 is assembled to the vehicle body 16, and outer connector 18 has been fully mated with inner bracket 20.

Figure 7:
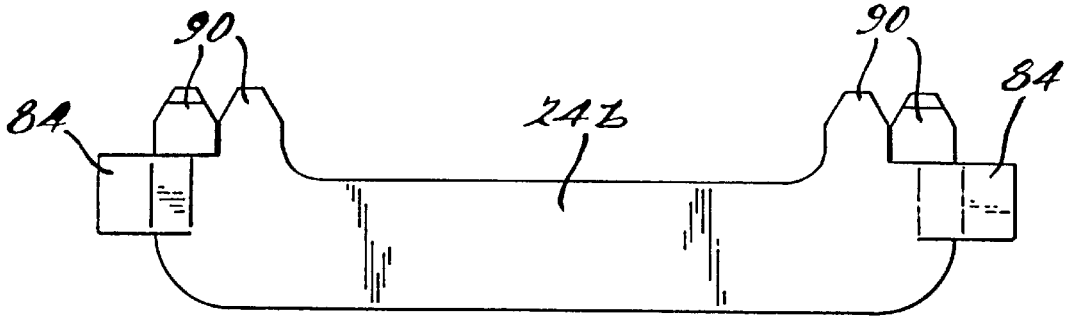
FIG. 7 is a front view of a snap lock for enclosing the outer bracket of the present invention.
Figure 8:
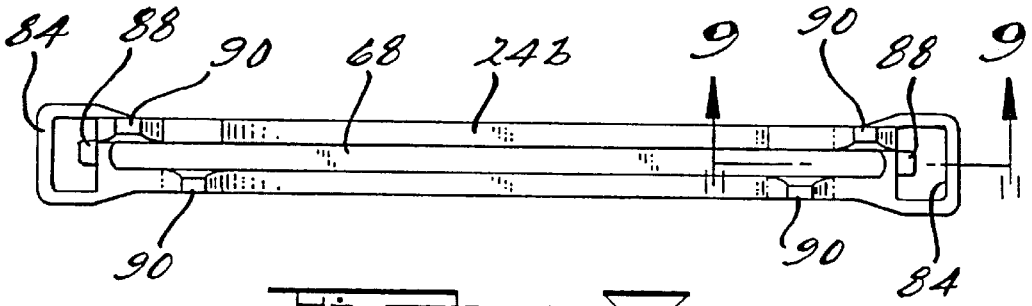
FIG. 8 is a top view of the snap lock shown in FIG. 7.
Figure 9:
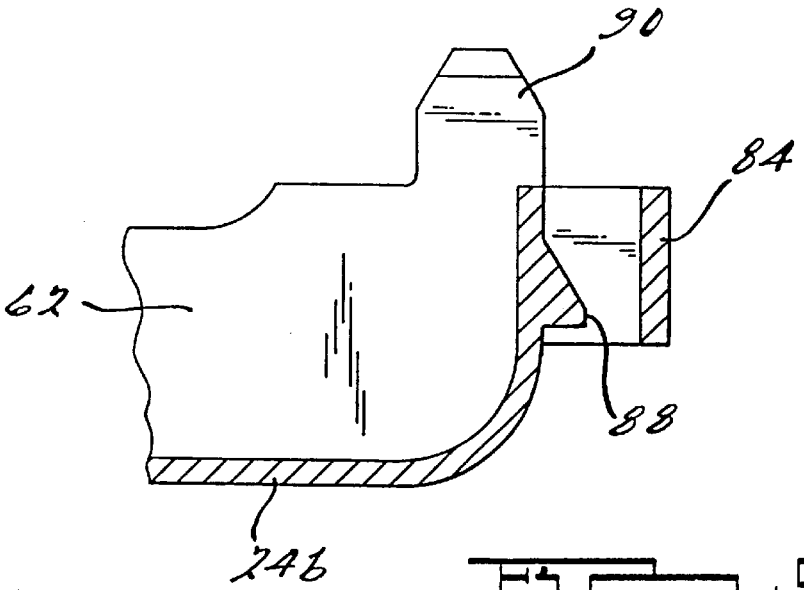
FIG. 9 is a cross-sectional view taken along line 9—9 of FIG. 8.
Figure 10:
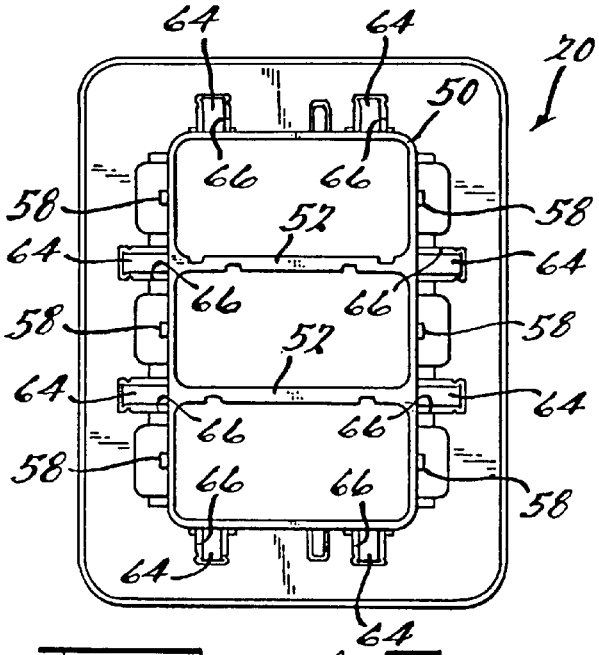
FIG. 10 is a front view of an inner bracket of a connector holding assembly.
Figure 11:
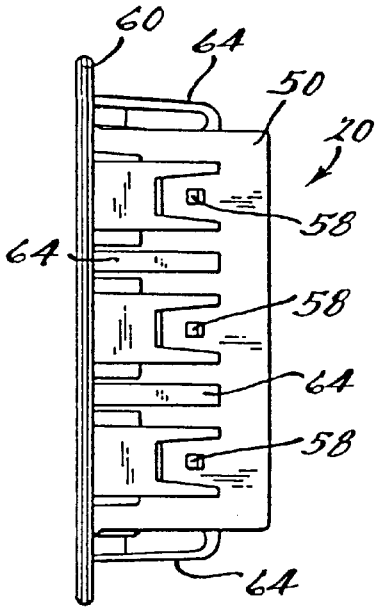
FIG. 11 is a side view of the inner bracket shown in FIG. 10.
Figure 12:
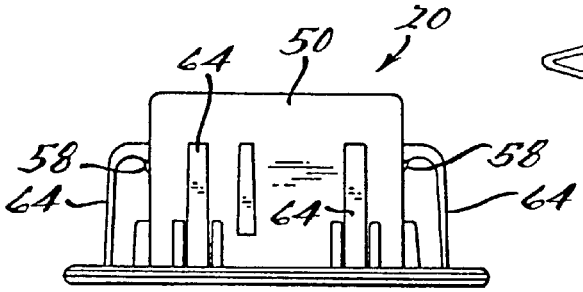
FIG. 12 is an end view of the inner bracket shown in FIG. 10.

Outer bracket 24 includes a main bracket portion **24*a* (illustrated in FIGS. 4–6) and a snap lock bracket portion 24*b* (illustrated in FIGS. 7–9). Main bracket portion 24*a* is provided with a pair of latch fingers 82 which are received in finger receptors 84 of snap lock bracket portion 24*b*. Latch fingers 82 are provided with a slot 86 which is engaged by locking tab 88 disposed within finger receptor 84. Snap lock bracket portion 24*b* also includes a plurality of guide teeth 90 which are received in tooth receptor portions 92 of main bracket portion 24*a*. Because snap lock bracket portion 24*b* is removable from main bracket 24*a* of outer bracket 24, inner bracket 20 can be removed from outer bracket 24** for maintenance.

During assembly of an instrument panel 12 into a vehicle, the connector holding assembly 22 is mounted to the dash panel 16 or another mounting surface provided with holes for receiving prongs 70 of outer bracket 24. Inner bracket 20 is provided with a plurality of connector assemblies 32, as needed, and wire harnesses 14 is connected to the connector assemblies 32. Stationary or fixed connector 18 is mounted to the instrument panel assembly 12 and is provided with a plurality of terminals attached to various wires of wire harness 10. As the instrument panel 12 is brought toward dash panel 16, funnel surface 43 of stationary or fixed connector 18 engages the upper surface 44 of the outer wall 50 of inner bracket 20. If the stationery or fixed connector 18 and inner bracket 20 are not properly aligned, funnel surface 43 will guide inner bracket 20 to a properly aligned position whereby lateral spring members 64 allow lateral adjustment of inner bracket 20 relative to outer bracket 24 in the x and y lateral directions.

Figure 16:
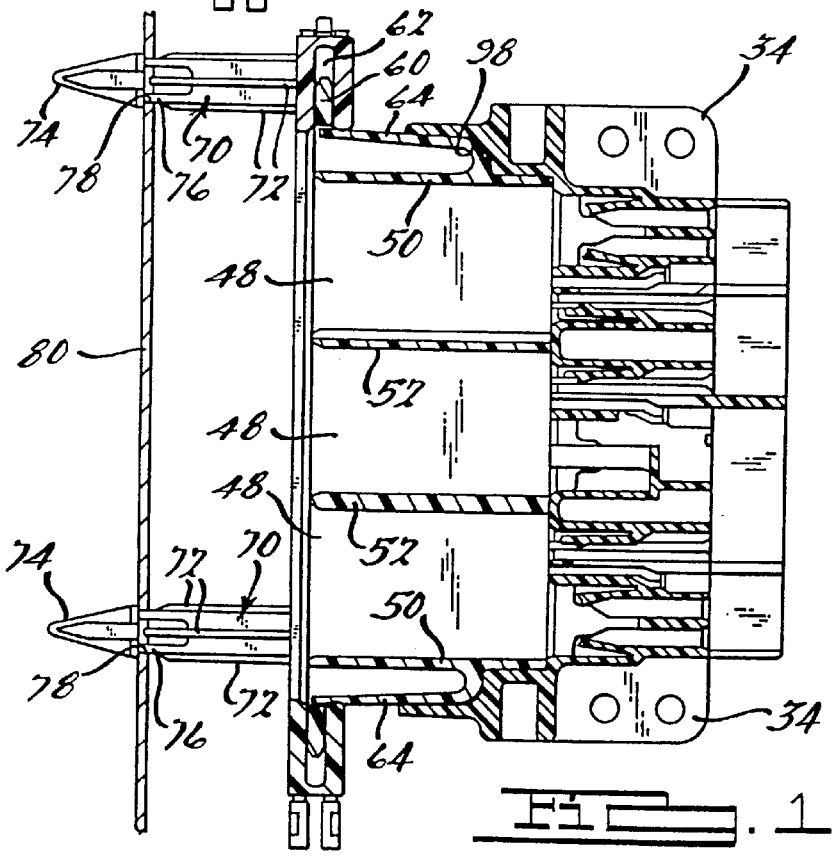
FIG. 16 is a cross-sectional view illustrating the stationary connector engaged with the inner bracket of the adjustable connector assembly.

As the stationary or fixed connector 18 is brought into complete contact with inner bracket 20, lateral spring members 64 are fully received within spring recess portions 98 of stationary or fixed connector 18, as shown in FIG. 16. As the instrument panel 12 is fully assembled to dash panel 16, the variances in the longitudinal (z direction) positioning of stationary or fixed connector 18 relative to inner bracket 20 can be compensated by prongs 70 of outer bracket 24 being adjustably seated longitudinally in holes 78 of mounting surface 80. Thus, the connector holding assembly 22 enables movement of inner bracket 20 in two lateral directions (x and y) relative to outer bracket 24.

In addition, the ability of prongs 70 to be adjustably seated, allows the instrument panel connector system to be adjustable in the longitudinal (z) direction.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrical connector, comprising:

a first connector member supporting at least one electrical terminal;

a second connector member supporting at least one electrical terminal for mating with said at least one electrical terminal supported by said first connector member when one of said first and second connector members is moved longitudinally toward the other of said first and second connector members; and a bracket for supporting said second connector member, said second connector member being laterally movable in two directions relative to said bracket, said bracket including a plurality of prongs which are received in openings in a mounting surface, said plurality of prongs being capable of being automatically adjustably seated longitudinally relative to said openings when said first and second connector members engage each other.

2. The electrical connector according to claim 1, wherein said first connector member is provided with a funnel surface for engaging with said second connector member.

3. The electrical connector according to claim 1, wherein said second connector member includes a flange portion slidably received in a slot of said bracket.

4. The electrical connector according to claim 3, wherein said second connector member further includes a plurality of lateral spring members for engaging said bracket.

5. The electrical connector according to claim 1, wherein said plurality of prongs include at least one crush rib disposed on a side surface thereof.

6. A self docking instrument panel connector system, comprising:

a first connector member supporting at least one electrical terminal, said first connector member attached to one of an instrument panel assembly and a body of a vehicle;

a second connector member supporting at least one electrical terminal for mating with said at least one electrical terminal supported by said first connector member when said first connector member is moved longitudinally toward said second connector member, said second connector member attached to the other of said instrument panel assembly and said body of a vehicle;

a bracket for supporting said second connector member, said second connector member being laterally movable relative to said bracket, said bracket being mounted to said other of said instrument panel assembly and said body of a vehicle and being capable of moving longitudinally relative thereto.

7. The connector system according to claim 6, wherein said first connector member is provided with a funnel surface for engaging with said second connector member.

8. The connector system according to claim 6, wherein said second connector member includes a flange portion slidably received in a slot of said bracket.

9. The connector system according to claim 8, wherein said second connector member further includes a plurality of lateral spring members for engaging said bracket.

10. The connector system according to claim 6, wherein said bracket includes a plurality of prongs which are received in openings in a mounting surface of said other of said instrument panel assembly and said body of a vehicle.

11. The connector system according to claim 10, wherein said prongs are provided with means for being adjustably seated in said openings in said mounting surface.

12. The connector system according to claim 11, wherein said means include at least one crush rib disposed on each of said prongs.

* * * * *